US005643861A

United States Patent [19]

de Guertechin et al.

[11] Patent Number: 5,643,861

[45] Date of Patent: Jul. 1, 1997

[54] NEAR TRICRITICAL POINT COMPOSITIONS CONTAINING A BLEACH AND/OR A DISINFECTING AGENT

[75] Inventors: Louis Oldenhove de Guertechin, Heks; Michel Julémont, Heusy, both of Belgium

[73] Assignee: Colgate-Palmolive Co., Piscataway, N.J.

[21] Appl. No.: 558,212

[22] Filed: Nov. 17, 1995

Related U.S. Application Data

[63] Continuation-in-part of Ser. No. 300,105, Sep. 2, 1994, Pat. No. 5,527,485, which is a continuation-in-part of Ser. No. 191,893, Feb. 4, 1994, abandoned.

[51] Int. Cl.[6] ..... C11D 7/150

[52] U.S. Cl. ..... 510/365; 510/367; 510/391; 510/407; 510/416; 510/475; 510/506; 252/186.1; 252/186.42; 252/186.43

[58] Field of Search ..... 252/142, 143, 252/162, 170, 173, 174.21, 174.25, DIG. 8, DIG. 14, 186.1, 186.42, 186.43; 510/365, 406, 416, 475, 506

[56] References Cited

U.S. PATENT DOCUMENTS 5,108,643 4/1992 Loth et al. ..... 252/162

FOREIGN PATENT DOCUMENTS 2194547 3/1988 United Kingdom .

*Primary Examiner*—Ponnathapura Achutamurthy
*Attorney, Agent, or Firm*—Richard E. Nanfeldt; James Serafino

[57] ABSTRACT

The present invention relates to a bleach or disinfecting aqueous cleaning composition which is useful for the removal of grease or tar without any mechanical action. In particular, the instant compositions are derived from three liquid phases which merge together at the tricritical point to form one continuum forming the aqueous cleaning composition, wherein the three phases incorporate at least a polar solvent, a non-polar solvent or weakly polar solvent and a water soluble or water low molecular weight water dispersible amphiphile and the composition contains a bleach and disinfecting agent.

14 Claims, No Drawings

NEAR TRICRITICAL POINT COMPOSITIONS CONTAINING A BLEACH AND/OR A DISINFECTING AGENT

RELATED APPLICATION

This application is a continuation in part application of U.S. Ser. No. 8/300,105 filed Sep. 2, 1994, now U.S. Pat. No. 5,527,485, which in turn is a continuation in part application of U.S. Ser. No. 8/191,893 filed Feb. 4, 1994, now abandoned.

FIELD OF THE INVENTION

The present invention relates to an aqueous bleach or disinfecting, cleaning composition which is optionally surfactant-free and is useful for the control of bacteria, fungus, molds, spores, viruses and germs as well as for the removal of grease, soap scum or tar without any mechanical action. In particular, the instant compositions comprise a bleachant system incorporated in three liquid phases which merge together in the vicinity of a tricritical point to form one continuum, wherein each of the three phases essentially contain a polar solvent, a non-polar solvent or a weakly polar solvent and a water soluble or water dispersible low molecular weight amphiphile.

BACKGROUND OF THE INVENTION

Liquid aqueous synthetic organic detergent compositions have long been employed for human hair shampoos and as dishwashing detergents for hand washing of dishes (as distinguished from automatic dishwashing, machine washing of dishes). Liquid detergent compositions have also been employed as hard surface cleaners, as in pine oil liquids, for cleaning floors and walls. More recently, they have proven successful as laundry detergents too, apparently because they are convenient to use, are instantly insoluble in wash water, and may be employed in "pre-spotting" applications to facilitate removal of soils and stains from laundry upon subsequent washing. Liquid detergent compositions have comprised anionic, cationic and nonionic surface active agents, builders and adjuvants including, as adjuvants, lipophilic materials which can act as solvents for lipophilic soils and stains. The various liquid aqueous synthetic organic detergent compositions mentioned above serve to emulsify lipophilic materials including oily soils in aqueous media, such as wash water, by forming micellar dispersions and emulsions.

A cleaning action can be regarded as a more-or-less complex process resulting in the removal of soils from a given surface. The driving forces generally involved in this process are mechanical energy (friction, attrition, sonification, suction etc.), solvation by a liquid, thermal agitation, soil-solvent interfacial tension reduction, chemical modifications (caustic, acidic, oxidative, reductive, hydrolysis, perhydrolysis, condensation, complexation, assisted or not by photoinduction, catalysts or enzymes), soil or soil residual suspension (e.g. in emulsions), and so on.

When the cleaning action takes place in water liquid vehicle, auxiliary cleaning agents, especially surfactants, are generally required to get rid of hydrophobic soils. Moreover, in most domestic cleaning tasks, the success of the cleaning mechanism is based on the reduction of the water/oil interfacial tension.

The generally admitted theory is that the oily soil is easily dispersed or emulsified in the composition because of the low interfacial tension existing between the washing liquor and the oil; due to the low interfacial tension, the liquid detergent composition easily wets the soil, diffuses through the soil or between the support and the soil, thereby weakening all bonding forces; the soil is then spontaneously removed from the substrate. This explains the removal of oily soil without a real solubilization of the soil.

Although emulsification is a mechanism of soil removal, it has been recently discovered how to make microemulsions which are much more effective than ordinary emulsions in removing lipophilic materials from substrates. Such microemulsions are described in U.S. Pat. Nos. 5,075,026; 5,085,584; 5,076,954 and 5,108,643 most of which relates to acidic microemulsions useful for cleaning hard surface items such as bathtubs and sinks, which microemulsions are especially effective in removing soap scum and lime scale from them. In U.S. patent application Ser. No. 07/267,872 the microemulsions may be essentially neutral and as such are also thought to be effective for microemulsifying lipophilic soils from substrates. In U.S. Pat. No. 4,919,829 there is described a light duty microemulsion liquid detergent composition which is useful for washing dishes and removing greasy deposits from them in both neat and diluted forms. Such compositions include complexes of anionic and cationic detergents as surface active components of the microemulsions.

The various microemulsions referred to include a lipophile which may be a hydrocarbon, a surfactant which may be an anionic and/or a nonionic detergent(s), a co-surfactant which may be a poly-lower alkylene glycol lower alkyl ether, e.g. tripropylene glycol monomethyl ether, and water.

Although the manufacture and use of detergent compositions in microemulsion form significantly improves cleaning power and greasy soil removal, compared to the usual emulsions, the present invention improves them still further by the formation of aqueous near tricritical cleaning compositions which have improved cleaning as compared to microemulsions.

The instant aqueous cleaning compositions, which are optionally surfactant-free, provide increased grease, soap scum and tar removal capabilities without or with a minimum mechanical action as compared to the water-based microemulsions as disclosed in U.S. Pat. Nos. 5,075,026, 5,108,643; 4,919,839 and 5,082,584. These water-based microemulsions all contain a surfactant as compared to the preferred surfactant-free compositions of the instant invention.

In most domestic cleaning tasks, the success of the cleaning mechanism is based on reduction of the water/oil interfacial tension. In this frame, the thermodynamic of phases predicts that ultra-low interfacial tensions can be reached in the direct vicinity of peculiar compositions called "critical points" and particularly near "tricritical points," the properties of which were extensively described by Griffiths (Robert B.) Wheeler (John C.) Critical points in multicomponent systems, Phys. Rev. A, NEW YORK 1970, 2, (3), (Sept.), pp.: 1047–1064; and Griffiths (Robert B.). Thermodynamic model for tricritical points in ternary and quaternary fluid mixtures. J. Chem. Phys., LANCASTER. 1974, 60, (1), pp.: 195–206; and Widom. B. Tricritical points in three—and four—component fluid mixtures J. Phys. Chem., WASHINGTON. 1973, 77, (18), pp.: 2196–2200; and Widom (B.) Interfacial tensions of three fluid phases in equilibrium. J. Chem. Phys. Lancaster, 1975, 62 (4) pp: 1332–13360 and Lang (J. C.) Widom (B.) Equilibrium of three liquid phases and approach to the tricritical point in benzene-ethanol-water-ammonium sulfate mixtures.

Physica A, AMSTERDAM. 1975, 81A, pp.: 190–213; and Widom (B.) Three-phase equilibrium and the tricritical point. Kinan, MEXICO. 1981, 3, A, pp.: 143–157

It must be pointed out that, in such critical compositions, surfactants are not a must. Moreover, it is not absolutely essential to be right at a tricritical point to obtain surface tensions much lower than those currently achieved with today's cleaning systems.

It is worthwhile to note that the tricritical points theory has already been under high scrutiny in view of enhancing oil recovery. These works are extensively described by Fleming (P. D.) Vinatieri (J. E.), Phase behavior of multicomponent fluids. J. Phys. Chem., WASHINGTON. 1977, 66, (7), pp.: 3147–3154 and Vinatieri (James E.) Fleming (Paul D.) Use of pseudocomponents in the representation of phase behavior of surfactant systems. Soc. Pet. Eng. J., DALLAS, 1979, 19, pp.: 289–300; and Fleming (Paul D.) Vinatieri (James E.). Quantitative interpretation of phase volume behavior of multicomponent systems near critical points. AIChE J., NEW YORK 1979, 25, (3), pp.: 493–502; and Fleming (Paul D.) Vinatieri (James E.). Role of critical phenomena in oil recovery systems employing surfactants. J. Colloid Interface Sci., NEW YORK. 1981, 81, (2), pp.: 319–331; and Vinatieri (James) Fleming (Paul D.), Multivariate optimization of surfactant systems for tertiary oil recovery. Soc. Pet. Eng. J., DALLAS. 1981, (2), pp.: 77–88; and Smith (Duane. H.). Interfacial tensions near the tricritical points of classical liquids: experimental evidence for the validity of the prediction of critical scaling theory. J. Chem. Phys., LANCASTER 1986, 85, PP.: 1545–1558. and Smith (Duane H.), Tricritical points as an aid to the design of surfactants for low-tension enhanced oil recovery. AOSTRA J. Res., EDMONTON(Alberta) 1984, (4), pp: 245–265.

In 1926, Kohnstamm rose the theoretical possibility of a critical point "of the second order" in a ternary liquid mixture, a point at which three co-existing fluid phases merge and become identical, Kohnstamm (Ph.). Handbuch der physik, 1926, Vol. 10, Kap. 4, Thermodynamik der Gemische, pp. 270–271, H. Geiger and K. Scheel (SPRINGER, BERLIN). Kohnstamm also stressed the extreme difficulty to find such a point.

Bleaching cleaning, oxidizing and disinfectant and compositions have been used in home and industrial applications for hard surface care and fabric care.

Hypochlorite bleaches are very effective at removal of stains, when they are used in relatively high concentrations, but these hypochlorite, as well as other active chlorine bleaches, can cause rather severe damage to fabric colors as well as damaging textile fibers. Additionally, these hypochlorite liquid bleaches can present handling and packaging problems. Color and fabric damage can be minimized by the use of milder oxygen bleaches such as potassium monopersulfate; however, stain removal characteristics of these peroxygen bleaches are much less desirable than those of the harsher halogen bleaching agents. Commercial bleaching compositions which contain peroxygen bleaches commonly utilize activators; which are compounds that enhance the performance of the peroxygen bleachant. Bleaching compositions which have employed various types of bleach activators have been disclosed in: Popkin, U.S. Pat. No. 1,940,768, Dec. 26, 1933; Baevsky, U.S. Pat. No. 3,061,550, Oct. 30, 1962; Mackellar et al, U.S. Pat. No. 3,338,839, Aug. 29, 1967; and Woods, U.S. Pat. No. 3,556,711, Jan. 19, 1971. The instantly disclosed bleachant activators represent an improvement over these previously disclosed activators for the cleaning of fabrics and hard surfaces because of the ability of the formulator to formulation bleachant compositions which are activate at room temperature while causing less damage to the fabric being cleaned.

Hydrogen peroxide and surfactant mixtures have been disclosed in European Patent Application and Patent Nos: EP 0376,704B1; EP 0376706A1 and EP 0009839B2.

The bleach or disinfecting aqueous cleaning near tricritical point compositions which of the instant invention are applicable for use in concentrated household care products. The instant near tricritical point compositions permit the preparation of cleaning or liquid products which are optionally surfactant-free.

In accordance with the present invention, a bleach or disinfecting near tricritical point cleaning composition, suitable at room temperature or colder or at a higher temperature for pre-treating and cleaning materials soiled with a lipophilic soil, comprises a bleachant system together with a polar solvent such as water, a water soluble or dispersible low molecular weight amphiphile, and a non-polar solvent, or weakly polar solvent wherein the three phases have merged into one continuum at the tricritical point. The invention also relates to the killing of fungus, molds, spores, viruses, germs and bacteria as well as to a processes for treating items and materials soiled with soils such as lipophilic soil, with compositions of this invention, to loosen and to remove without mechanical action such soil by applying to the locus of such soil on such material a soil loosening or removing amount of the near tricritical point compositions of the instant invention. Disinfecting means obtaining a germ killing effect or microorganism killing effect.

The instant bleach or disinfecting aqueous cleaning composition exists at or in the vicinity of the tricritical point which is the terminus of three lines of critical points. The tricritical point is a thermodynamical point at which all three co-existing phases become identical simultaneously. At the tricritical point, the interfacial tension between the merging phases in which the polar solvent and the low molecular weight amphiphile are respectively at their highest concentrations is substantially zero, and the interfacial tension between the merging phases in which the low molecular weight amphiphile and the non-polar or weakly polar solvent (oil) are respectively at their highest concentrations is substantially zero, and the interfacial tension between the merging phases in which the polar solvent and the non-polar or weakly polar solvent are respectively at their highest concentrations, is substantially zero. Accordingly, the cleaning mechanism of the cleaning compositions of the instant invention is based on the reduction of the polar solvent/non-polar solvent interfacial tension as it approaches the value of zero.

The compositions of the instant invention have a phase inversion temperature (PIT) of about 0° to about 80° C., more preferably about 15° to about 40° C. The phase inversion temperature is the temperature at which there is an equal affinity of the low molecular weight amphiphile for water and for oil. It is the temperature at which the partition of the low molecular weight amphiphile between the water-rich phase and the non-polar-solvent-rich phase or weakly-polar-solvent-rich phase equals unity. That is, the weight fraction of the low molecular weight amphiphile in the water-rich phase is equal to the weight fraction of the low molecular weight amphiphile in the non-polar-solvent-rich phase.

The tricritical point compositions have $$\text{a ratio } (\alpha) = \frac{\text{wt \% of oil}}{\text{wt \% of water + wt \% of oil + wt. \% of additives}}$$

$$\text{and a ratio } (\gamma) = \frac{\text{wt \% of low molecular weight amphiphile}}{\text{100 wt \% of composition}}$$

$$\text{and a ratio } (\epsilon) = \frac{\text{wt \% of additive}}{\text{wt \% of water + wt. \% of additive}}$$

wherein the weight fraction of the water is equal to $(1-\gamma)(1-\alpha)(1-\epsilon)$ and $\alpha$ is about 0.01 to about 0.50 more preferably about 0.05 to about 0.30, $\gamma$ is about 0.01 to about 0.40, more preferably about 0.03 to about 0.25, and $\epsilon$ is about 0 to about 0.20, more preferably about 0.01 to about 0.05, wherein the additive is a water soluble additive, a polar co-solvent or an electrolyte.

The additives are water soluble molecules (electrolytes or organics) that are able to modify the structure of water so as to strengthen or disrupt the solvent structure. Addition of such chemicals will therefore modify the solubility of uncharged organic ingredients in water and, among others, of amphiphilic molecules. The above chemicals are divided into two classes: Salting-out (or kosmotropic) agents reinforce the structure of water and make it less available to hydrate organic molecules. Salting-in (or chaotropic) agents, on the other hand, disorder the structure of water, thereby creating an effect comparable to "holes". As a consequence they increase the solubility of polar organic molecules in water. (Salting-out and -in agents are also referred to as lyotropes and hydrotropes, respectively.)

In practice, lyotropic agents make water more incompatible with both oil and amphiphile. The result is a decrease of the PIT and an increase of the supertricritical character. The amount of low molecular weight amphiphile needed to "congregate" water and oil generally increases in the presence of salting-out agents. Hydrotropic agents have the opposite effects.

SUMMARY OF THE INVENTION

The instant invention relates to an aqueous near tricritical point composition having an apparent viscosity at $10^2$ $sec^{-1}$ and 25° C., of about 1 to 10,000 cps, more preferably about 1 to 1,000 cps, most preferably about 1 to 100 cps, and a surface tension of about 10 to about 35 mN/m, which comprises approximately by weight: 55 to 95 wt % of a polar solvent; 1 to 15 wt % of a non-polar solvent or a weakly polar solvent, and about 1 to about 23 wt % of water soluble or water dispersible low molecular weight amphiphile, about 0 to about 60 wt. %, more preferably about 1 to about 60 wt. %, most preferably about 11 to about 18 wt. % of a 25 to 50 wt. % solution of hydrogen peroxide and about 0 to about 5 wt. %, more preferably about 0.2 to about 4 wt. % of an optional disinfecting agent.

Accordingly, it is an object of the instant invention to provide an aqueous near tricritical point cleaning composition which is useful in a cleaning operation without or with a minimum of mechanical action for the control of bacteria, fungus, molds and germs as well as for removal of grease, soap scum and tar and especially for the penetration of the near tricritical composition into a porous surface thereby destroying the adhesion of soil to the substrate.

DETAILED DESCRIPTION OF THE INVENTION

The present invention relates to an aqueous near tricritical point composition having an apparent viscosity at $10^2$ $sec^{-1}$ and 25° C., of about 1 to 10,000 cps, more preferably about 1 to 1,000 cps, most preferably about 1 to 100 cps, and a surface tension of about 10 to about 35 mN/m, which comprises approximately by weight:

a) 1 to 15% of a non-polar solvent or a weakly polar solvent or mixtures thereof, more preferably 2 to 12% and most preferably 2 to 10%;

b) 1 to 23%, more preferably 2 to 20% and most preferably 3 to 18%, of a water soluble or water low molecular weight dispersible amphiphile;

c) 55 to 95%, more preferably 70 to 94% and most preferably 74 to 94%, of a polar solvent, wherein the composition is optionally surfactant-free;.

d) 0 to 60 wt. %, more preferably about 1 to about 60 wt. %, most preferably 11 to 18 wt. % of a 25 to 50 wt. % solution of a peroxygen bleach;

(e) 0 to 5 wt. %, more preferably 0.1 to about 4 wt. % of an optional disinfecting agent.

(f) 0 to 20%, more preferably 0.5 to 15% and most preferably 1.0 to 10% of a water soluble additive, wherein the composition can optionally contain at least one solid particle and/or immiscible solvent which is not the non-polar or weakly polar solvent in the composition;

The bleach or disinfecting near tricritical point compositions of the instant invention have three coexisting liquid phases that are capable of being converted into one single phase by weak mechanical action according to a reversible equilibrium or to make the three co-existing liquid phases merge together into one continuum to form the tricritical point composition.

In the following section, all mentions of wt. % concentrations ($X_1$, $X_2$, $X_3$, X, $Y_1$, $Y_2$, $Y_3$, Y, $Z_1$, $Z_2$, $Z_3$, Z) are expressed with reference to the whole composition and not reference to the considered singular phase. The wt. % concentration of the polar solvent in the first phase is represented by $X_1$ and the wt. % concentration of the polar solvent in the second phase is represented by $X_2$ and the wt. % concentration of the polar solvent in the third phase is represented by $X_3$, wherein the total wt. % concentration (X) of the polar solvent in the composition is equal to $X_1+X_2+X_3$, wherein $X_1$, $X_2$ and $X_3$ are approximately equal to each other. The concentration of the polar solvent can tolerate variations of ±5 absolute wt. % (i.e. with reference to the whole composition =100%), more preferably of ±2 absolute wt. % and most preferably of ±1 absolute wt. % in each of the three phases. For example, if the total concentration of the polar solvent (X) in the composition is 81 wt. %, the concentration of the polar solvent in each of the three phases is about 22 wt. % to about 32 wt. %, more preferably about 25 wt. % to 29 wt. % and most preferably about 26 wt. % to about 28 wt. %, wherein $X_1>X_2$ or $X_3$.

The wt. % concentration of the water soluble or water dispersible low molecular weight amphiphile in the first phase is represented by $Y_1$ and the wt. % concentration of the amphiphile in the second phase is represented by $Y_2$ and the wt. % concentration of the amphiphile in the third phase is represented by $Y_3$, wherein the total wt. % concentration (Y) of the amphiphile in the composition is equal to $Y_1+Y_2+Y_3$, wherein $Y_1$, $Y_2$ and $Y_3$ are approximately equal to each other. The concentration of the low molecular weight amphiphile can tolerate variations of ±2 absolute wt. % and more preferably ±1 absolute wt. % in each of the three phases. For example, if the total concentration of the low molecular weight amphiphile (Y) in the composition is 9 wt. %, the concentration of the low molecular weight amphiphile in each of the three phases is about 1 wt. % to about 5 wt. %, more preferably about 2 wt. % to 4 wt. %, wherein $Y_2>Y_1$ or $Y_3$.

The wt. % concentration of the non-polar solvent (also weakly polar solvent) in the first phase is represented by $Z_1$ and the wt. % concentration of the non-polar solvent in the second phase is represented by $Z_2$ and the wt. % concentration of the non-polar solvent in the third phase is represented by $Z_3$, wherein the total wt. % concentration (Z) of the non-polar solvent in the composition is equal to $Z_1+Z_2+Z_3$, wherein $Z_1$, $Z_2$ and $Z_3$ are approximately equal to each other. The concentration of the nonpolar solvent can tolerate variations of ±5 absolute wt. %, more preferably ±2 absolute wt. % and most preferably ±1 absolute wt. % in each of the three phases. For example, if the total concentration of the non-polar or weakly polar solvent (Z) in the composition is 9 wt. %, the concentration of the non-polar solvent in each of the three phases is about 1 wt. % to about 5 wt. %, more preferably about 2 wt. % to 4 wt. %, wherein $Z_3>Z_1$ or $Z_2$.

The bleach or disinfecting near tricritical point compositions unlike true microemulsions which are optically clear exhibit a critical opalescence in that the tricritical point composition appears opalescent.

When the bleach or disinfecting near tricritical point composition is at the tricritical point the three phases merge into one single phase, wherein $X_1=X_2=X_3$ and $Y_1=Y_2=Y_3$ and $Z_1=Z_2=Z_3$ in the single phase.

The bleach or disinfecting aqueous near tricritical point compositions of the instant invention can be used as a basic formulation for the production of both commercial and industrial applications by the incorporation of selective ingredients in the tricritical point composition. Typical compositions which can be formed for a variety of applications are fabric cleaners, shampoos, floor cleaners carpet cleaners, cleaning pastes, tile cleaners, bath tub cleaners, bleach compositions, disinfecting cleaners, ointments, oven cleaners, stain removers, bleach pre-spotters, dishwashing prespotters, automatic dishwashing compositions, laundry pre-spotters, and cleaning pre-spotters and graffiti or paint removers and mildew cleaner for grouts.

The present invention relates to a bleach or disinfecting liquid cleaning composition which is optionally surfactant-free having a surface tension of about 10 to about 35 mN/m at 25° C. deriving from three co-existing liquid phases which are almost chemically identical to each other and the three co-existing liquid phases have merged together into one continuum to form the composition, wherein the first phase has the highest polar solvent concentration, the second phase has the highest water soluble or water dispersible amphiphile concentration and the third phase has the highest non-polar solvent or weakly polar solvent concentration and the interfacial tension between said first phase and said second phase is 0 to about $1\times10^{-3}$ mN/m and the interfacial tension between the second phase and the third phase is 0 to about $1\times10^{-3}$ mN/m, and the interfacial tension between the first phase and the third phase is 0 to about $1\times10^{-3}$ mN/m.

In a preferred composition, the polar solvent is water at a concentration of about 55 to about 95 wt %, the low molecular weight amphiphile is an organic compound having a water insoluble hydrophobic portion which has a partial Hansen polar parameter and hydrogen bonding parameter, both of which are less than about 5 $(MPa)^{1/2}$, and a water soluble hydrophilic portion which has a partial Hansen hydrogen bonding solubility parameter greater than about 10 $(MPa)^{1/2}$; the amphiphile is present at a concentration of about 1 to about 23 wt %; and non-polar solvent or weakly polar solvent has a Hansen dispersion solubility parameter greater than about 10 $(MPa)^{1/2}$ and a Hansen hydrogen bonding solubility parameter of less than about 15$(MPa)^{1/2}$, being present at a concentration of about 1 to about 15 wt %.

The main characteristic of the polar solvent is that it has the ability to form hydrogen bonding with the low molecular weight amphiphile and the polar solvent has a dielectric constant of higher than 35. Besides water, other polar solvents suitable for use in the instant composition are formamide, glycerol, glycol and hydrogen peroxide and mixtures thereof. The aforementioned polar solvents can be mixed with water to form a mixed polar solvent system. The concentration of the polar solvent such as water in the near tricritical point composition is about 55 to 95 wt %, more preferably about 70 to about 94 wt %.

The organic non-polar or weakly polar solvent component of the present bleach or disinfecting aqueous near tricritical point compositions includes solvents for the soils, is lipophilic. The non-polar solvent or weakly polar solvent has a Hansen dispersion solubility parameter at 25° C. of at least 10 $(MPa)^{1/2+ee}$, more preferably at least about 14.8 $(MPa)^{1/2}$, a Hansen polar solubility parameter of less than about 10 $(MPa)^{1+fin\ 1/2}$ and a Hansen hydrogen bonding solubility parameter of less than about 15 $(MPa)^{1/2}$. In the selection of the non-polar solvent or weakly polar solvent, important parameters to be considered are the length and configuration of the hydrophobic chain, the polar character of the molecule as well as its molar volume.

The non-polar solvent or weakly polar solvent, which at 25° C. is generally less than 5 wt % soluble in water, can be selected from the group consisting of alkylene glycol alkyl ethers having the formula:

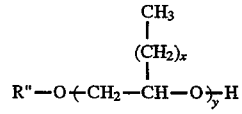

wherein R" is an alkylene group having about 4 to about 14 carbon atoms and x is 1 to 13 and y is about 2 to about 7 and can be selected from the group consisting of weakly water soluble polyoxyethylene alkyl ethers derivatives having the formula:

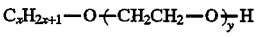

wherein x and is 6 to 18, more preferably 8 to 12 and y is equal to or lower than x/3 and esters having the formula:

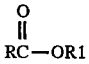

wherein R and $R_1$ are alkyl, alkylene or α-hydroxyalkyl groups having about 7 to about 24 carbon atoms, more preferably about 8 to about 20 carbon atoms and diesters having the formula:

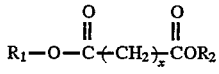

or

-continued

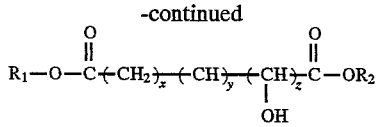

wherein $R_1$ and $R_2$ are alkyl groups having about 2 to about 10 carbon atoms, more preferably about 3 to about 8 carbon atoms and x is about 1 to 12, y is 0 to 2 and z is about 0 to 2 and terpenes or oxygenated terpenes.

Some typical non-polar solvents or weakly polar solvents are decylacetate, ethylene glycol monohexyl ether, diethylene glycol monohexyl ether, disopropyl adipate, octyl lactate, dioctyl maleate, dioctyl malate, diethylene glycol mono octyl ether, Dobanol® 91-2.5 EO, limonene, pinene, dipentene, terpineol and mixtures thereof.

The concentration of the non-polar solvent or weakly polar solvent in the bleach or disinfecting near tricritical point composition is about 1 to about 15 wt %, more preferably about 2 to about 12 wt %.

The concentration of the low molecular weight amphiphile in the bleach or disinfecting near tricritical point composition is about 1 to about 23 wt %, more preferably about 2 to about 20 wt %.

The low molecular weight amphiphile of the instant composition is a molecule composed of at least two parts which is capable of bonding with the polar solvent and the non-polar solvent. Increasing the molecular weight of the low molecular weight amphiphile increases its water/oil coupling ability which means less low molecular weight amphiphile is needed to couple the polar solvent and the non-polar solvent or weakly polar solvent. At least one part is essentially hydrophobic, with a Hansen partial polar and hydrogen bonding solubility parameters less than 5 $(MPa)^{1/2}$. At least one part is essentially water soluble, with Hansen hydrogen bonding solubility parameter equal or greater than 10 $(MPa)^{1/2}$.

To identify the hydrophilic and hydrophobic parts, the low molecular weight amphiphilic molecule must be cut according to the following rules: The hydrophobic parts should not contain any nitrogen or oxygen atoms; the hydrophilic parts generally contain the hetero-atoms including the carbon atoms directly attached to an oxygen or nitrogen atom.

| Group | MW | $\delta_d$ | $\delta_p$ | $\delta_h$ |
|---|---|---|---|---|
| $—CH_2—OH$ | 31 | 15.5 | 16.1 | 25.4 |
| $—CH_2—NH_2$ | 30 | 13.8 | 9.3 | 16.7 |
| $—CO—NH_2$ | 44 | 13 | 14.1 | 13.4 |
| $—CH_2—NH—CO—NH_2$ | 73 | 13.7 | 11.4 | 13.6 |
| $—CH_2—EO—OH$ | 75 | 14.9 | 3.1 | 17.5 |
| $—CH_2—EO_2—OH$ | 119 | 14.8 | 2.6 | 14.8 |
| $—CH_2—EO_3—OH$ | 163 | 14.7 | 2.1 | 13.3 |
| $—CH_2—EO_4—OH$ | 207 | 14.7 | 1.9 | 12.4 |
| $—COO—CH_3$ | 59 | 13.7 | 8.3 | 0 |
| $—CO—CH_3$ | 43 | 16.5 | 17.9 | 18.8 |
| $—C_3H_7$ | 43 | 13.7 | 0 | 0 |
| $—C_4H_9$ | 57 | 14.1 | 0 | 0 |
| $—C_{10}H_{21}$ | 141 | 15.8 | 0 | 0 |

This table shows the solubility parameters for different groups. The first series can be used as the hydrophilic part of an amphiphile molecule, as the hydrogen bonding solubility parameter is always greater than 10. The last group can be used as the hydrophobic part of an amphiphile, as their polar and hydrogen bonding solubility parameters are below 1. The group in the middle (esters and ketones) cannot be used as a significant contribution to an amphiphile molecule. It is noteworthy that amphiphiles can contain ketone or ester functions, but these functions do not contribute directly to the amphiphile performance. $\delta_d$ is the Hansen dispersion solubility parameter as measured at room temperature; $\delta_p$ is the Hansen polar solubility parameter as measured at room temperature; $\delta_h$ is the Hansen hydrogen bonding solubility parameter as measured at room temperature. The global values of $\delta_d$, $\delta_p$ and $\delta_h$ related to a molecule cannot be deduced from a simple addition of groups solubility parameters; indeed, groups solubility parameters contribute differently to the molecular solubility parameters and must be ponderated according to the inverse of the molar volume of the molecule. In particular preferred low molecular weight amphiphiles, which are present at a concentration of about 1 to about 23 wt %, more preferably about 2 to about 20 wt %, are selected from the group consisting of polyoxyethylene derivatives having the formula:

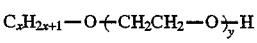

wherein x and/or y is 1 to 10, more preferably 1 to 6, polyols having 4 to 8 carbon atoms, polyamines having 5 to 7 carbon atoms, polyamides having 5 to 7 carbon atoms, alkanols having 2 to 4 carbon atoms and alkylene glycol alkyl ethers having the formula:

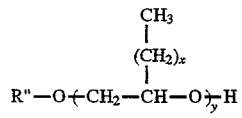

wherein R" is an alkylene group having about 4 to about 8 carbon atoms and x is 0 to 2 and y is about 1 to about 5. The molecular weight of the low molecular weight amphiphile is about 76 to about 300, more preferably about 100 to about 250. Especially preferred low molecular weight amphiphiles are ethylene glycol monobutyl ether (EGMBE), diethylene glycol monobutyl ether (DEGMBE), triethylene glycol monohexyl ether and tetraethylene glycol monohexyl ether and mixtures thereof such as ethylene glycol monobutyl ether (EGMBE) and diethylene glycol monobutyl ether (DEGMBE) in a ratio of about 1:2.

The bleach or disinfecting near tricritical point compositions formed from the previously described low molecular weight amphiphiles are surfactant free because these previously described low molecular weight amphiphiles are not classified as surfactants.

However, bleach or disinfecting near tricritical point compositions can be optionally formed from a polar solvent, a non-polar or weakly polar solvent and a surfactant or a mixture of a low molecular weight amphiphile and surfactant, when the surfactant is employed without a low molecular weight amphiphile, the surfactant is present in the composition at a concentration of about 3.0 to about 8.0 wt. percent. When the surfactant is employed in the composition with the low molecular weight amphiphile the concentration of the surfactant is about 0.1 to about 6.0 weight percent and the concentration of the low molecular weight amphiphile is about 1 to about 25 wt. percent. The surfactants that are employed in the instant invention are selected from the group consisting of nonionics, anionics, amine oxides, cationics and amphoteric surfactants and mixtures thereof. An especially preferred nonionic surfactant is Dobanol 91-5. When the surfactant is used alone and without a low molecular weight amphiphile the surfactant must preferably have an HLB of about 7 to 14. It is to be understood that surfactants are a subset of the set of amphiphiles. The low molecular weight amphiphiles do not form aggregates at an interface for example, the interface of oil and water, but rather the low molecular weight amphiphile is evenly distributed throughout the solution. Whereas a surfactant is proned to concentrate at the interfaces between different phases (air/liquid; liquid/liquid; liquid/solid) thereby forming aggregates at the interface and decreasing the interfacial tension between the above coexisting phases. For example a surfactant will form aggregates at an oil/liquid interface and the surfactant will not be evenly distributed throughout the solution.

The instant near tricritical point compositions contain about 0 to about 30 wt. %, more preferably 2.5 to about 25 wt. %, most preferably about 4 to about 20 wt. % of a peroxygen bleach selected from the group consisting of hydrogen peroxide, sodium perborate $NaBO_3.xH_2O$ (x=1 or 4 for perborate monohydrate or tetrahydrate respectively), sodium percarbonate (and sodium carbonate peroxyhydrate) $Na_2CO_3$. 1.5 $H_2O_2$ and mixtures thereof. The preferred bleach is a 35 wt. % solution of hydrogen peroxide in water.

The instant near tricritical point compositions can optionally contain about 0.1 to about 5 wt. %, more preferably about 0.2 to about 4 wt. % of disinfecting agent selected from the group consisting of quaternaries such as an alkyl dimethyl benzylammonium chloride wherein the alkyl group has about 10 to about 20 carbon atoms, preferably 12 carbon atoms (Benzalkonium chloride), alkyl trimethyl ammonium chloride, wherein the alkyl group has about 10 to about 20 carbon atoms, preferably 16 carbon atoms (cetrimonium chloride), polyhexamethylene biguanide hydrochloride (Cosmocil CQ) and 3-(trimethoxysily) propyl alkyl dimethyl ammonium chloride, wherein the alkyl group has about 10 to about 22 carbon atoms, preferably 18 carbon atoms (DC5700-Dow Corning) and polyhexamethylene biguanides and Sodium hypochlorite, chlorohexidine, alcohols having 1 to 3 carbon atoms, aldehydes having 1 to 6 carbon atoms, phenolic type compounds such as cresol, xylenol, hydroxybenzoic acids as well as alkyl phenols, alkylchlorophenols and alkylbromophenol derivatives; N-chloramines such as chloramine T, dichloramine T, halazone, trichlorocyanuric acid, chloroazodin and succinchlorimide and mixtures thereof.

The instant composition can optionally contain about 0.1 to about 15 wt %, more preferably about 1 to about 5 wt % of a water soluble chaotropic additive which can be hydrotropic or kosmotropic. A hydrotropic agent weakens (salting-in effect) the structure of the water thereby making the water an improved solvent for the amphiphile, whereas a kosmotropic (lyotropic) agent strengthens (salting-out effect) the structure of the water thereby making water less of a solvent for the amphiphile. Typical hydrotropic agents are acetic acid, ethanol, isopropanol, sodium benzoate, sodium toluene sulfonate, sodium xylene sulfonate, sodium cumene sulfonate, ethylene glycol, propylene glycol, metal salts of iodide, metal salts of thiocyanates, metal salts of perchlorates, guanidinium salts. The use of the chaotropic additive can change the weight percentage of the polar solvent, amphiphile and non-polar solvent used to form the near tricritical point composition.

In addition to the recited components of the bleach or disinfecting aqueous near tricritical point compositions of the present invention, there may also be present adjuvant materials for dental, dishwashing, laundering and other detergency applications, which materials may include: foam enhancing agents such as lauric or myristic acid diethanolamide; foam suppressing agents (when desired) such as silicones, higher fatty acids and higher fatty acid soaps; preservatives and antioxidants such as formalin and 2,6-ditert-butyl-p-cresol; pH adjusting agents such as sulfuric acid and sodium hydroxide; perfumes; and colorants (dyes and pigments).

The instant compositions can optionally contain an inorganic or organic builder salt provided that the salt is not present at a concentration that destroys the character of the near-tricritical point compositions. The builder salt is generally present at a concentration of about 1 to about 30 wt. %, more preferably about 2 to about 10 wt. %. The builder salt is selected from the group consisting of isoserine diacetate acid, alkali metal carbonates, alkali metal bicarbonates, alkali metal citrates, alkali metal salts of a polyacrylic acid having a molecular weight of about 500 to 4,000, alkali metal tartarates, alkali metal gluconates, alkali metal silicates, alkali metal tripolyphosphates and alkali metal pyrophosphates and mixtures thereof. The maximum concentration of the builder salt in the bleach or disinfecting near tricritical point composition is determined by and limited by the solubility of the builder salt in the water phase, wherein the builder salt is completely dissolved in the water phase.

The variations in formulas of the bleach or disinfecting compositions within the invention which are in the tricritical or near tricritical state are easily ascertainable, and the invention is readily understood when reference is made to this specification, including the working examples thereof, taken in conjunction with the phase diagrams.

In the previous description of the components of the invented compositions and proportions thereof which may be operative, boundaries were drawn for preferred compositions within the invention, but it will be evident that one seeking to manufacture the invented near tricritical point compositions will select proportions of components indicated by the phase diagrams for the particular compositions, so that the desired compositions will be within the near tricritical area. Similarly, the tricritical point compositions selected should be such that upon contact with water, the lipophilic soil will be removed from a substrate.

For plotting of the phase diagrams and in experiments undertaken by the inventors to establish the formulas of the desired tricritical point compositions, many different compositions within the invention were made and were characterized.

To make the bleach or disinfecting near tricritical point compositions of the invention is relatively simple because they tend to form spontaneously with little need for the addition of energy to promote transformation of the near tricritical state. However, to promote uniformity of the composition, mixing will normally be undertaken and it has been found desirable, but not compulsory, to first mix the bleach and water together, followed by admixing of the non-polar solvent or weakly solvent component and of the amphiphile. It is not usually necessary to employ heat and most mixings are preferably carried out at about 20°–25° C. or higher.

Pre-spotting and manual cleaning uses of the invented near tricritical point compositions are uncomplicated, requiring no specific or atypical operations. Thus, such near tricritical point compositions may be employed in the same manner as other liquid pre-spotting and detergent compositions.

The invented near tricritical point compositions may be applied to such surfaces with a cloth or sponge, or by various other contacting means, but it is preferred to apply them, depending on their viscosity. Such application may be applied onto hard surfaces such as dishes, walls or floors from which lipophilic (usually greasy or oily) soil is to be removed, or may be applied onto fabrics such as laundry which has previously been stained with lipophilic soils such as motor oil. The invented compositions may be used as detergents and as such may be employed in the same manner in which liquid detergents are normally utilized in dishwashing, floor and wall cleaning, and laundering, but it is preferred that they are employed as pre-spotting agents too, in which applications they are found to be extremely useful in loosening the adhesions of lipophilic soils to substrates, thereby promoting much easier cleaning with application of more of the same invented detergent compositions or by applications of different commercial detergent compositions in liquid, bar or particulate forms.

EXAMPLES

The following examples illustrate but do not limit the invention. Unless otherwise indicated, all parts in these examples, in the specification and in the appended claims are by weight percent and all temperatures are in ° C.

The formulas A through F were prepared according to the following procedure:

Compositions A through F were made by first forming with mixing at room temperature a solution of the bleach and the water or the water and additive. To this solution at room temperature were added successively with mixing the non-polar solvent (oil) or weakly polar solvent and the amphiphile and then subsequently was added the optional disinfecting agent to form the near tricritical point compositions A through F.

EXAMPLE 1

| | A | B | C | D | E | F |
|---|---|---|---|---|---|---|
| COMPOSITION | | | | | | |
| Water | 60.71 | 61.79 | 51.55 | 58.17 | 69.15 | 65.44 |
| d-limonene | 10.94 | 12.26 | 4.6 | 12.02 | 4 | 8.7 |
| Triethylene glycolhexylether | | | 20 | | 13 | 13 |
| Diethylene glycolhexylether | 10.5 | 9.6 | | 11.2 | | |
| Cetrimoniumchloride (25% solution) | 4 | | | | | |
| Benzalkoniumchloride (80% solution) | | 2.5 | | | | |
| Polyhexamethylene biguanide (20% solution) | | | 10 | | | |
| DC5700 (42% in MeOH) | | | | 4.76 | | |
| $H_2O_2$ (35% solution) | 12.85 | 12.85 | 12.85 | 12.85 | 12.85 | 12.86 |
| Perfume | 1.0 | 1.0 | 1.0 | 1.0 | 1.0 | |
| MICROBIOLOGY TESTS | | | | | | Log. reduction |
| DEFT[1] | Alive /dead | Alive | Dead | Dead | Alive | |
| LA[1] | 0 | + | + | + | ++ | |
| French NormAFNOR NFT72-190[2] | | | | | | |
| *Pseudomonas aeriginosa* | | | | | | >8 |
| *Staphylococcus aureus* | | | | | | 8 |
| European Norm EN1650[2] | | | | | | |
| *Candida albicans* dirty conditions | | | | | | 6 |
| clean conditions | | | | | | >6 |
| *Aspergius niger* dirty conditions | | | | | | 4 |
| clean conditions | | | | | | 3 |
| *Rhodoto rulaminuta* dirty conditions | | | | | | >6 |
| clean conditions | | | | | | >6 |
| European Norm EN1040[3] | | | | | | |
| *Staphylococcus aureus* | | | | | | ≧5 |
| *Pseudomonas aeriginosa* | | | | | | >7 |

[1]Microbiology tests procedures: DEFT and LA (applied to examples A to E):
Stainless steel pieces have been let for 3 weeks in water to induce natural microbial biofilm installation. Stainless steel pieces have been then treated in duplicate with the above described examples A to E: contact time is 5 minutes; then rinsed in sterile distilled water for 1 minute. One piece has been immediately treated for Direct Epifluorescence Technique (DEFT evaluation) and the replicate has been inserted in Letheen Agar (LA).
Direct Epifluorescence Technique (DEFT) has been applied immediately and Letheen Agar (LA) inserted pieces have been incubated at RT for 3 weeks.
For the Letheen Agar (LA) test, results are expressed with the following codes:
0 = no germ growth
+ = slight germ growth
++ = moderate germ growth
+++ = heavy germ growth
[2]EN1650: Quantitative suspension test for the fungicidal activity of chemical disinfectants and antiseptics used in food industrial, domestic, and institutional areas [(CEN216) (Commission Europienne de Normalisation)]
[3]EN1040: Basic Bacterial Disinfection Test [(CEN216) (Commission Europienne de Normalisation)]

The invention has been described with respect to various embodiments and illustrations of it but is not to be considered as limited to these because it is evident that one of skill in the art with the present specification before him/her will be able to utilize substitutes and equivalents without departing from the invention.

What is claimed is:

1. A liquid cleaning composition having a surface tension of about 10 to 35 mN/m and incorporating 0 to 30 wt. % of a peroxygen bleach and about 0 to about 5 wt. % of a disinfecting agent, and at least a polar solvent, a water soluble or water dispersible low molecular weight amphiphile and a non-polar or weakly polar solvent and deriving from three co-existing liquid phases which are capable of being converted into one single phase according to a reversible equilibrium, wherein the first phase is the most abounding with the polar solvent, the second phase is the most abounding with the water soluble or water dispersible low molecular weight amphiphile and the third phase is the most abounding with the non-polar solvent or weakly polar solvent, and the interfacial tension between said first phase and said second phase is 0 to about $1\times10^{-3}$ mN/m, and the interfacial tension between second phase and third phase is 0 to about $1\times10^{-3}$ mN/m, and the interfacial tension between first phase and third phase is 0 to about $1\times10^{-3}$ mN/m, wherein said polar solvent is at a concentration of about 55 to about 95 wt. %.

2. A composition according to claim 1, wherein the polar solvent is water at a concentration of about 55 to about 95 wt %, the amphiphile being an organic compound having a water insoluble hydrophobic portion which has a partial polar parameter and hydrogen bonding parameter, both of which are less than about 5 $(MPa)^{1/2}$, and a water soluble hydrophilic portion which has a partial hydrogen bonding solubility parameter greater than about 10 (MPa)½; said amphiphile being present at a concentration of about 1 to about 23 wt %; and said non-polar solvent or weakly polar solvent having a dispersion solubility parameter greater than about 10 $(MPa)^{1/2}$ and a hydrogen bonding solubility parameter of less than about 15 $(MPa)^{1/2}$, said non-polar solvent or weakly polar solvent being present at a concentration of about 1 to about 15 wt %.

3. A composition according to claim 2, wherein said low molecular weight amphiphile is selected from the group consisting of alkylene glycol alkyl ethers, polyoxyethylene derivatives having the formula:

$$C_xH_{2x+1}-O\left(CH_2CH_2-O\right)_y-H$$

wherein x is about 4 to about 8 and y is 1 to 6, polyols having about 4 to about 8 carbon atoms, polyamines having about 5 to about 7 carbon atoms, polyamides having about 5 to about 7 carbon atoms, and alkanols having about 2 to about 4 carbon atoms.

4. A composition according to claim 3, wherein said non-polar solvent or weakly polar solvent is selected from the group consisting of alkylene glycol alkyl ethers having the formula:

$$R''-O\left(CH_2-\underset{\displaystyle (CH_2)_x}{\overset{\displaystyle CH_3}{\overset{|}{\underset{|}{CH}}}}-O\right)_y-H$$

wherein R" is an alkylene group having about 4 to about 8 carbon atoms and x is 3 to 13 and y is about 2 to about 7 and esters having the formula:

$$RC(=O)-OR_1$$

wherein R and $R_1$ are alkyl groups having about 7 to about 24 carbon atoms and terpenes or oxygenated terpenes.

5. A composition according to claim 1, wherein said polar solvent is water.

6. A composition according to claim 1, wherein said composition is sprayable by a hand operated pump sprayer.

7. A composition according to claim 1, containing at least one solid particle and/or immiscible liquid in said composition.

8. A composition according to claim 5, wherein said low molecular weight amphiphile is triethylene glycol monohexyl ether.

9. A composition according to claim 1, wherein said peroxygen bleach is selected from the group consisting of hydrogen peroxide, sodium perborate, sodium percarbonate, and sodium carbonate peroxyhydrate and mixtures thereof.

10. A composition according to claim 9, wherein said disinfecting agent is selected from the group consisting of quaternaries, polyhexamethylene biguanides, sodium hypochlorite, alcohols, aldehydes, chlorohexidine, N-chloramines, phenolic compounds and mixtures thereof.

11. A composition according to claim 1, wherein said peroxygen bleach is an aqueous solution of 25 wt. % to 50 wt. % of hydrogen peroxide.

12. A composition according to claim 11, wherein the concentration of the 25 wt. % to 50 wt. % aqueous solution of hydrogen peroxide in said composition is 1 to about 60 wt. %.

13. A composition according to claim 11, wherein said disinfecting agent is present at a concentration of about 0.1 wt. % to 5 wt. %, wherein said disinfecting agent is selected from the group consisting of alkyldimethylbenzyl ammonium chloride, alkyltrimethyl ammonium chloride, 3-(trimethoxysily) propyl alkyl dimethyl ammonium chloride, polyhexamethylene biguanide hydrochloride and mixtures thereof.

14. A composition according to claim 4 wherein said terpenes or oxygenated terpenes are selected from the group of limonene, pinene, dipentene, terpineol and mixtures thereof.

* * * * *